US007211224B2

(12) United States Patent
Olivier

(10) Patent No.: US 7,211,224 B2
(45) Date of Patent: May 1, 2007

(54) ONE PIECE FILTRATION PLATE

(75) Inventor: Stéphane Olivier, Rosheim (FR)

(73) Assignee: Millipore Corporation, Billerica, MA (US)

( * ) Notice: Subject to any disclaimer, the term of this patent is extended or adjusted under 35 U.S.C. 154(b) by 575 days.

(21) Appl. No.: 10/154,302

(22) Filed: May 23, 2002

(65) Prior Publication Data

US 2003/0219360 A1 Nov. 27, 2003

(51) Int. Cl.
*B01L 3/00* (2006.01)

(52) U.S. Cl. ..... 422/101; 422/99; 422/102; 422/946; 422/948; 435/288.3; 435/288.4; 435/288.5; 206/569

(58) Field of Classification Search ..... 422/99, 422/101, 102, 104, 942, 946, 948, 948 Q; 435/288.3, 288.4, 288.5; 206/569
See application file for complete search history.

(56) References Cited

U.S. PATENT DOCUMENTS

| | | | | |
|---|---|---|---|---|
| 3,471,019 | A | 10/1969 | Trasen et al. | 210/94 |
| 3,806,424 | A | 4/1974 | Rolinson | 195/127 |
| 4,167,875 | A | 9/1979 | Meakin | 73/421 R |
| RE30,562 | E | 3/1981 | Park | 435/296 |
| 4,299,920 | A | 11/1981 | Peters | 435/285 |
| 4,304,865 | A | 12/1981 | O'Brien et al. | 435/240 |
| 4,317,726 | A | 3/1982 | Shepel | 210/236 |
| 4,404,006 | A | 9/1983 | Williams et al. | 55/502 |
| 4,493,815 | A | 1/1985 | Fernwood et al. | 422/101 |
| 4,526,690 | A | 7/1985 | Kiovsky et al. | 210/335 |
| 4,734,192 | A | 3/1988 | Champion et al. | 210/335 |
| 4,797,259 | A * | 1/1989 | Matkovich et al. | 422/101 |
| 4,902,481 | A | 2/1990 | Clark et al. | 422/101 |
| 4,948,442 | A | 8/1990 | Manns | 156/73.1 |
| 5,047,215 | A | 9/1991 | Manns | 422/101 |
| 5,108,704 | A | 4/1992 | Bowers et al. | 422/70 |
| 5,141,718 | A | 8/1992 | Clark | 422/99 |
| 5,223,133 | A | 6/1993 | Clark et al. | 210/232 |
| 5,326,533 | A | 7/1994 | Lee et al. | 422/101 |
| 5,650,323 | A | 7/1997 | Root | 435/284.1 |
| 5,679,310 | A | 10/1997 | Manns | 422/102 |
| 5,846,493 | A | 12/1998 | Bankier et al. | 422/101 |
| 5,885,499 | A | 3/1999 | Aksberg | 264/153 |
| 5,906,796 | A | 5/1999 | Blevins et al. | 422/102 |
| 5,972,694 | A | 10/1999 | Mathus | 435/288.4 |
| 6,086,827 | A * | 7/2000 | Horner et al. | 422/102 |
| 6,309,605 | B1 | 10/2001 | Zermani | 422/101 |

FOREIGN PATENT DOCUMENTS

| | | |
|---|---|---|
| DE | 4143419 | * 12/1993 |
| EP | 0 328 038 | 8/1989 |
| EP | 0 359 249 | 3/1990 |
| EP | 0 131 934 | 12/1991 |
| EP | 1 110 610 | 6/2001 |
| WO | 82/03690 | 10/1982 |

(Continued)

*Primary Examiner*—Maureen M. Wallenhorst
(74) *Attorney, Agent, or Firm*—Nields & Lemack

(57) ABSTRACT

Laboratory device design particularly for a multiplate format that includes a plate or tray having a plurality of wells, and a drain in fluid communication with each of the plurality of wells. The plate is a one-piece design having a honeycomb structure that brings high rigidity to the plate in order to accept very high centrifugal load. The design also maximizes the well volume and active filtration area while remaining in compliance with SBS format.

14 Claims, 8 Drawing Sheets

FOREIGN PATENT DOCUMENTS

| | | |
|---|---|---|
| WO | 86/07606 | 12/1986 |
| WO | 97/15394 | 5/1997 |
| WO | 98/55233 | 12/1998 |
| WO | 00/66268 | 11/2000 |
| WO | 01/76717 | 10/2001 |
| WO | 01/78896 | 10/2001 |
| WO | 02/26364 | 4/2002 |
| WO | 02/096563 | 12/2002 |

* cited by examiner

FIG. 6
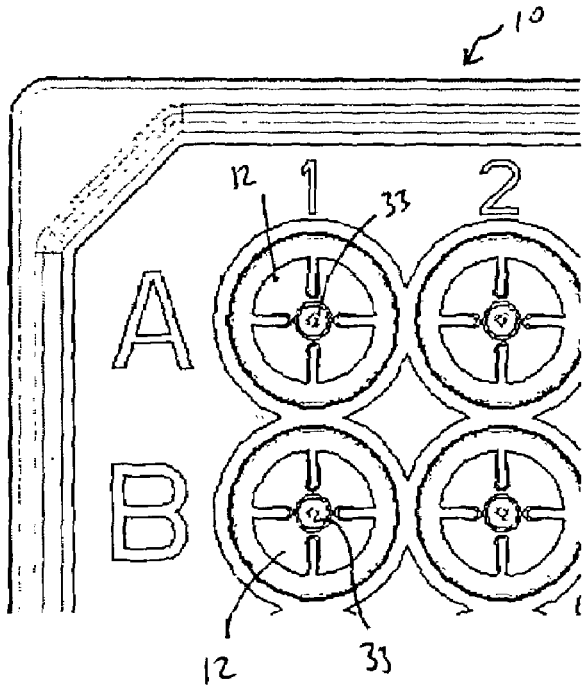
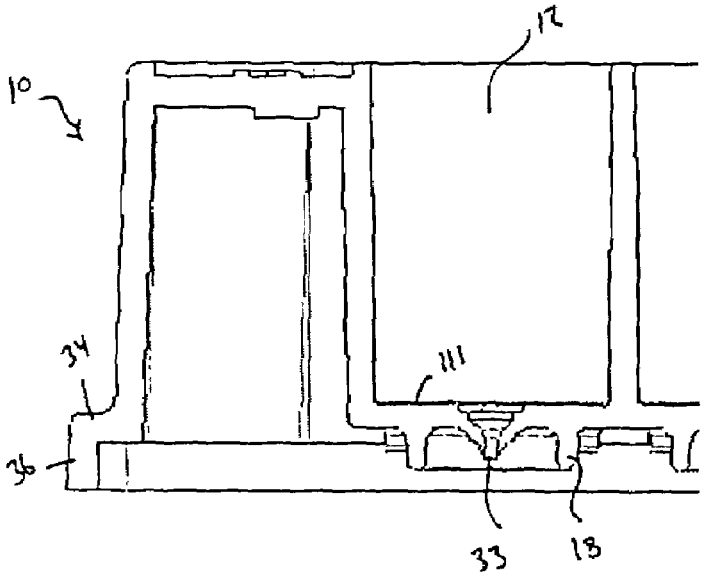
FIG. 7

ONE PIECE FILTRATION PLATE

BACKGROUND OF THE INVENTION

Test plates for chemical or biochemical analyses, or sample preparation and purification, which contain a plurality of individual wells or reaction chambers, are well-known laboratory tools. Such devices have been employed for a broad variety of purposes and assays, and are illustrated in U.S. Pat. Nos. 4,734,192 and 5,009,780, 5,141,719 for example. Microporous membrane filters and filtration devices containing the same have become particularly useful with many of the recently developed cell and tissue culture techniques and assays, especially in the fields of virology and immunology. Multiwell plates, used in assays, often utilize a vacuum applied to the underside of the membrane as the driving force to generate fluid flow through the membrane. Centrifugation also can be used. The microplate format has been used as a convenient format for plate processing such as pipetting, washing, shaking, detecting, storing, etc.

Typically, a 96-well filtration plate is used to conduct multiple assays or purifications simultaneously. In the case of multiwell products, a membrane is placed on the bottom of each of the wells. The membrane has specific properties selected to separate different molecules by filtration or to support biological or chemical reactions. High throughput applications, such as DNA sequencing, PCR product cleanup, plasmid preparation, drug screening and sample binding and elution require products that perform consistently and effectively.

One such filtration device commercially available from Millipore Corporation under the name "Multiscreen" is a 96-well filter plate that can be loaded with adsorptive materials, filter materials or particles. The Multiscreen underdrain has a phobic spray applied in order to facilitate the release of droplets. More specifically, the MultiScreen includes an underdrain system that includes a spout for filtrate collection. This spout not only directs the droplets but also controls the size of the droplets. Without the underdrain system, very large drops form across the entire underside of the membrane and can cause contamination of individual wells. Access to the membrane can be had by removing the underdrain. However, the device is not compatible with automated robotics equipment such as liquid handlers, stackers, grippers and bar code readers.

The Society for Biomolecular Screening (SBS) has published certain dimensional standards for microplates in response to non-uniform commercial products. Specifically, the dimensions of microplates produced by different vendors varied, causing numerous problems when microplates were to be used in automated laboratory instrumentation. The SBS standards address these variances by providing dimensional limits for microplates intended for automation.

It would therefore be desirable to provide a multiplate format that is in compliance with the SBS standards, yet maximizes well volume and is compatible with both vacuum and high speed centrifugation.

It also would be desirable to provide a multiplate format that is a one-piece design having high rigidity capable of withstanding high centrifugal load.

SUMMARY OF THE INVENTION

The problems of the prior art have been overcome by the present invention, which provides a laboratory device designed particularly for a multiplate format that includes a plate or tray having a plurality of wells, and a drain in fluid communication with each of the plurality of wells. The plate is a one-piece design having a honeycomb structure that brings high rigidity to the plate in order to accept very high centrifugal load. The design also maximizes the well volume and active filtration area while remaining in compliance with SBS format.

According to a preferred embodiment of the present invention, there is provided a multiwell device including a multiwell plate or tray having a support such as a membrane for filtration, each respective well of the device terminating in a spout which can direct fluid draining therefrom to a collection plate or the like without the need for a spacer. The plate is configured to maximize the volume of each well while conforming to SBS standards, and to minimize the distance between the exit orifice of the plate and a collection plate in order to minimize or avoid cross contamination. When positioned over a collection plate with corresponding wells, vents are provided to vent gases from the wells out of the device.

BRIEF DESCRIPTION OF THE DRAWINGS

FIG. 6 is a view showing four wells of a multiwell device in accordance with the present invention;

FIG. 7 is a cross-sectional view of a portion of the multiwell device in accordance with the present invention;

DETAILED DESCRIPTION OF THE INVENTION

Figure 1:
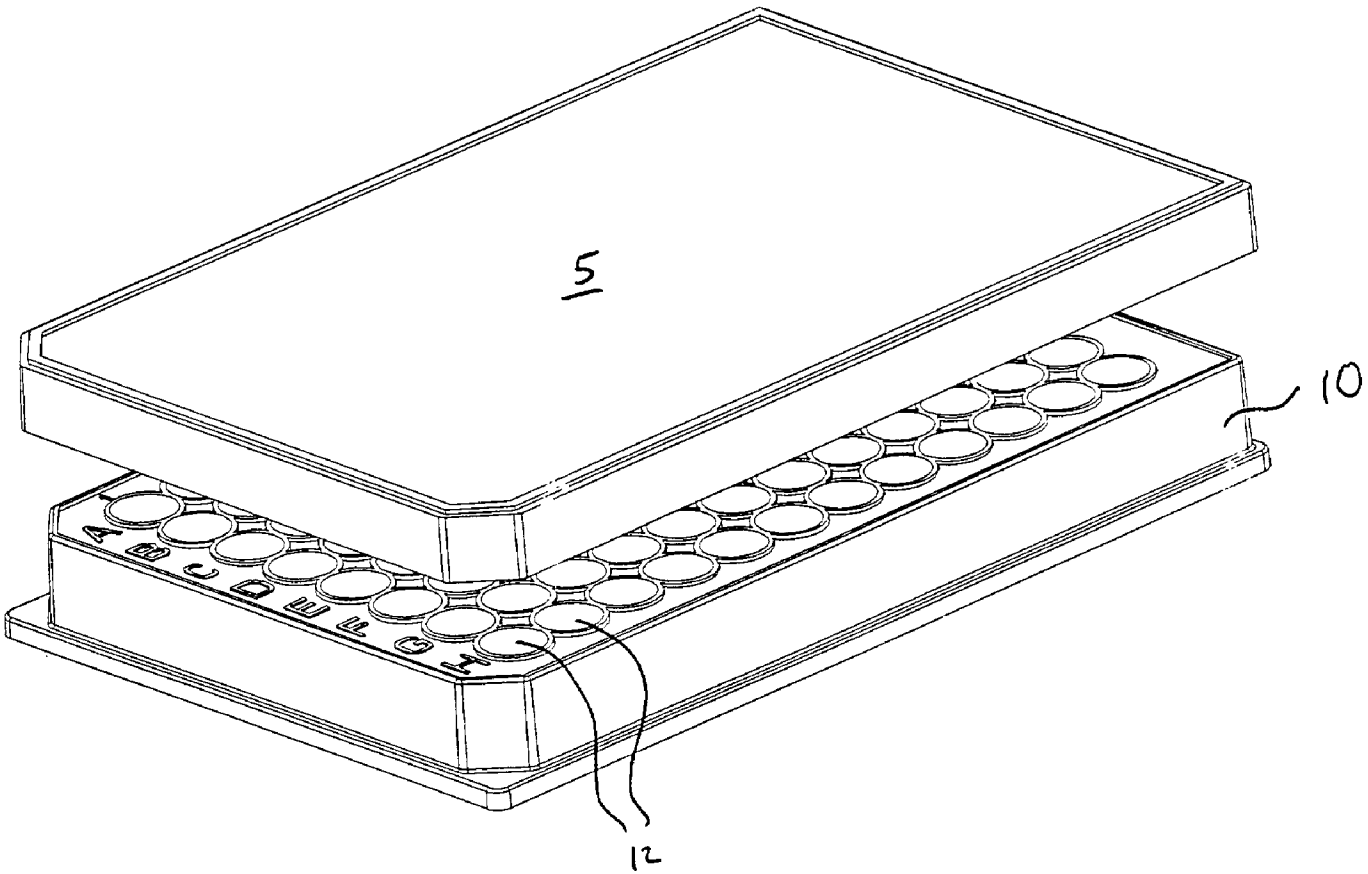
FIG. 1 is a perspective view of a multiwell device and cover in accordance with the present invention.
Figure 2:
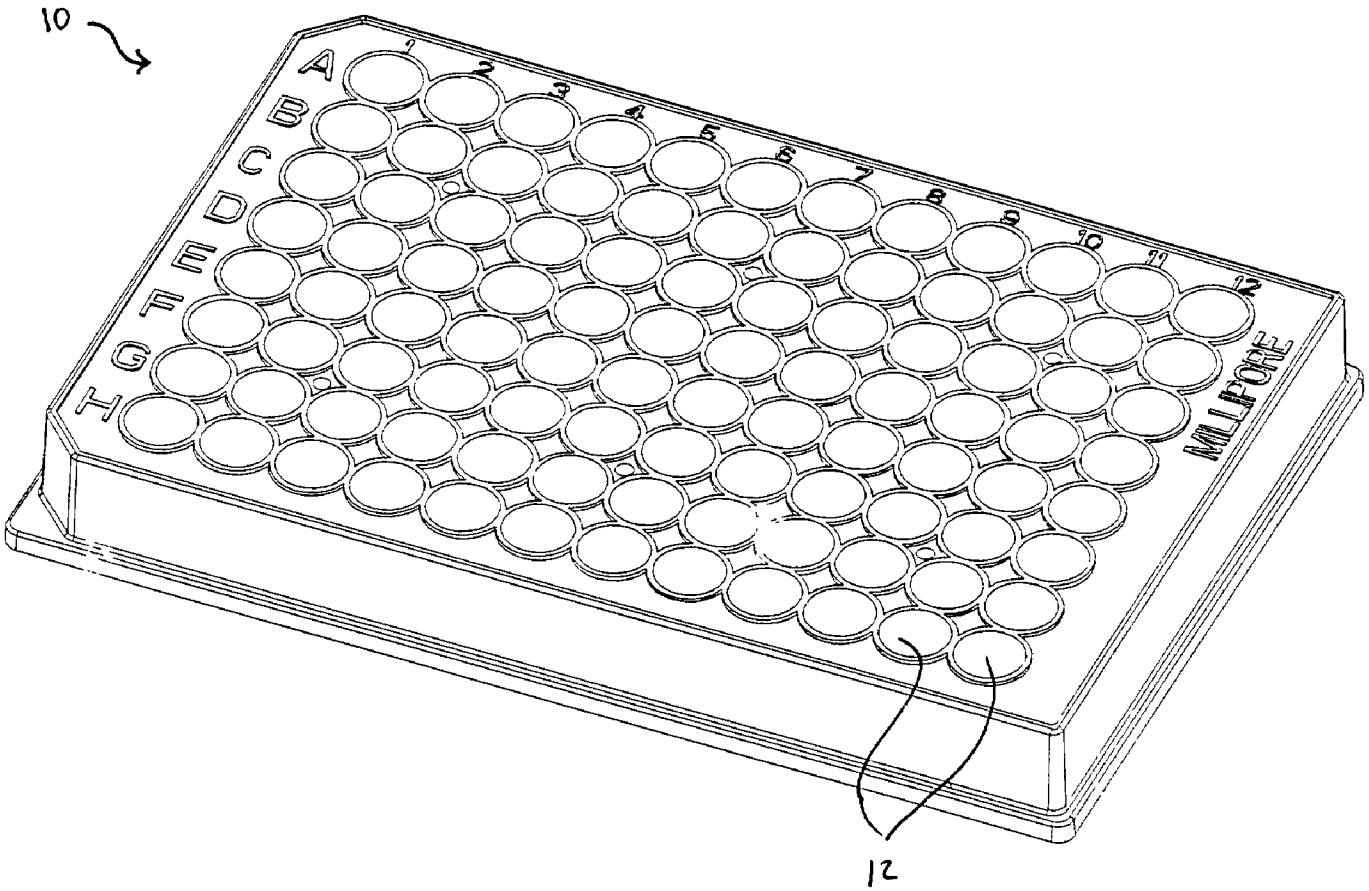
FIG. 2 is a perspective view of a multiwell device in accordance with the present invention.
Figure 3:
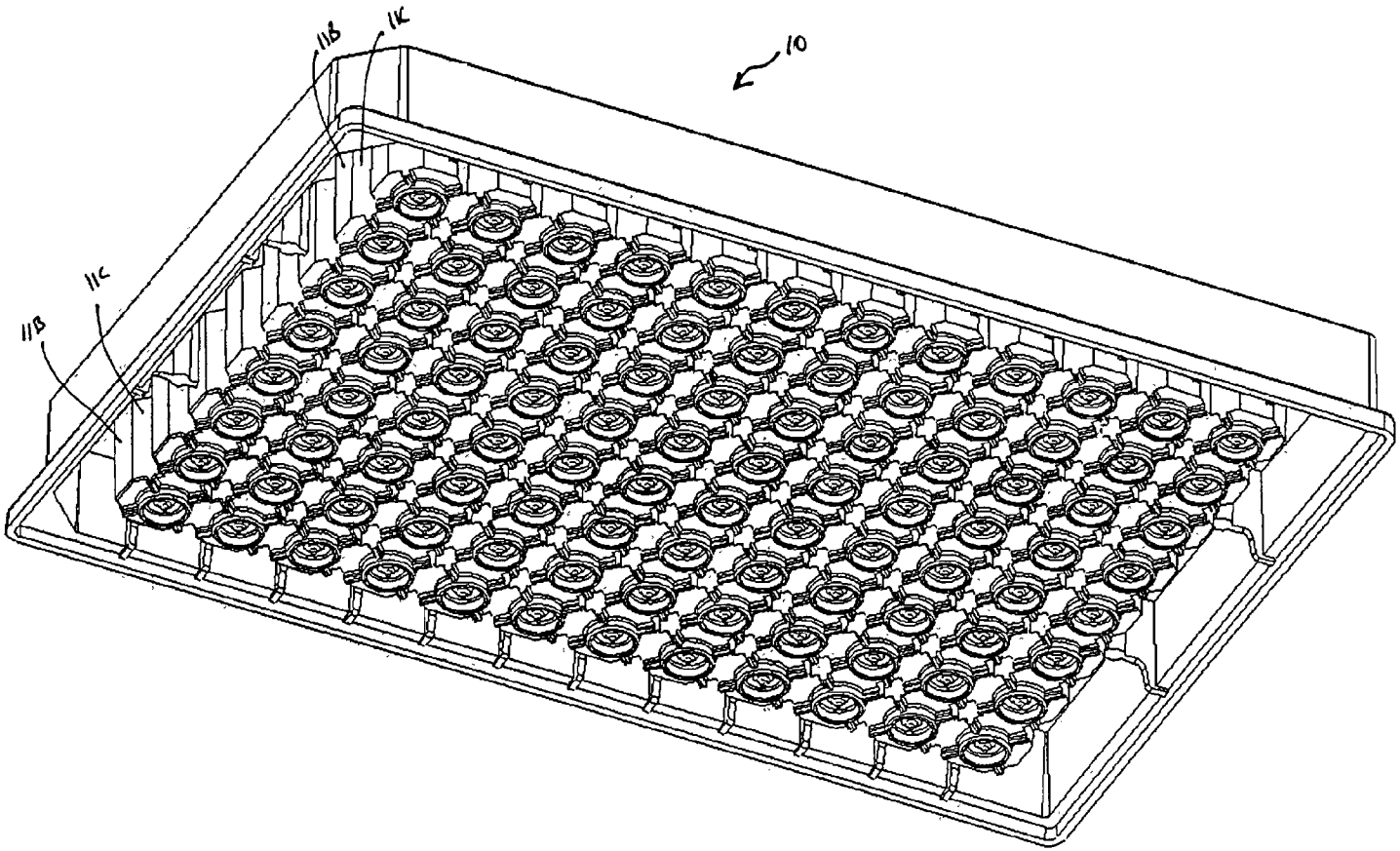
FIG. 3 is a bottom perspective view showing the underside of a multiwell device in accordance with the present invention.

Turning first to FIG. 1, there is shown a multiwell device including an optional removable protective cover 5, and a 96-well plate or tray 10. Although a 96-well plate array is illustrated, those skilled in the art will appreciate that the number of wells is not limited to 96; standard multiwell formats with 384, 1536 or fewer or more wells are within the scope of the present invention. The well or wells are preferably cylindrical with fluid-impermeable walls, although other shapes can be used. Where a plurality of wells is present, the wells are preferably interconnected and arranged in a uniform array, with uniform depths so that the tops and bottoms of the wells are planar or substantially planar. Preferably the array of wells comprises parallel rows of wells and parallel columns of wells, so that each well not situated on the outer perimeter of the plate is surrounded by eight other wells. The plate 10 is generally rectangular, although other shapes are within the scope of the present invention, keeping in mind the objective of meeting SBS dimensional standards.

Suitable materials of construction for the device of the present invention include polymers such as polycarbonates, polyesters, nylons, PTFE resins and other fluoropolymers, acrylic and methacrylic resins and copolymers, polysulphones, polyethersulphones, polyarylsulphones, polystyrenes, polyvinyl chlorides, chlorinated polyvinyl chlorides, ABS and its alloys and blends, polyolefins, preferably polyethylenes such as linear low density polyethylene, low density polyethylene, high density polyethylene, and ultra-high molecular weight polyethylene and copolymers thereof, polypropylene and copolymers thereof and metallocene generated polyolefins. Preferred polymers are polyolefins, in particular polyethylenes and their copolymers, polystyrenes and polycarbonates.

Figure 10:
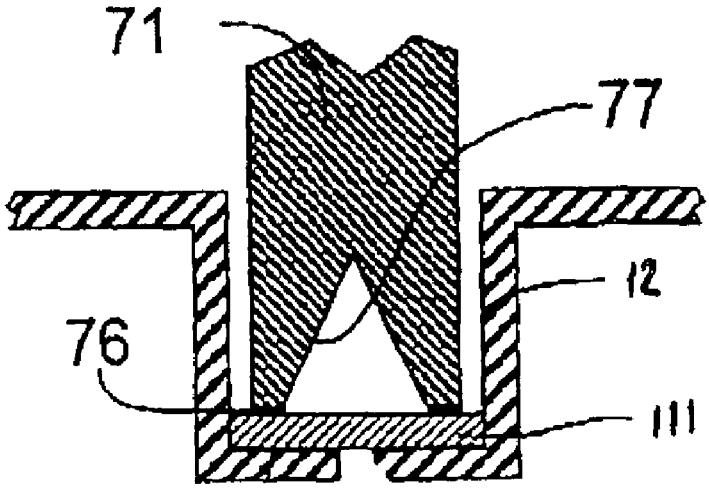
FIG. 10 is a cross-sectional view showing a method and device for sealing the support into the device of the present invention.

In the embodiment shown, the plate 10 includes a plurality of wells 12 having an open top and a bottom having a surface to which is sealed a substrate or support 111, such as a membrane. In view of the configuration of the well bottoms, the substrate 111 is preferably inserted into the well from the top, such as by a vacuum transfer operation. A disk of a size sufficient to cover the bottom of the well and be sealed to the well walls is formed such as by cutting, and transferred by vacuum inside each well 12. The disk is sealed to the well walls preferably by heat sealing, by contacting the periphery of the disk with a hot probe or the like. Care must be taken to avoid contacting the well walls with the hot probe to avoid melting. A suitable sealing technique is disclosed in U.S. Pat. No. 6,309,605 the disclosure of which is hereby incorporated by reference. With reference to FIG. 10, a filter sealing device which has a sealing surface which is heated is brought into contact with the upper filter surface and transfers its thermal energy to he surrounding filter and well material. The energy causes either the filter material or the well materials or both to soften and or melt and fuse together forming an integral, fluid tight seal. This process may be used when either the filter material or the well material or both are formed of a thermoplastic material. The sealing surface is only a portion of the filter surface and is a continuous structure so that a ring or peripheral area of the filter is sealed to the well so as to form a liquid tight seal between the filter, well and the opening in the bottom of the well. FIG. 10 shows sealing device 71 in the process of sealing a filter 111 to a portion of the well such that all fluid communication between the well 12 and the opening 75 in the bottom of the well 12 is through the filter 111. The sealing device 71, as shown has a sealing surface 76 spaced radially outward from the center of the device diameter and is the lowermost projection of the device. The remainder of the area of the sealing device lowermost face 77 is recessed in order to avoid contact with the filter 111. The sealing surface 76 is brought into contact with the surface of a filter 111 contained with the well 12. Thermal energy is transferred from the sealing device 71 to the area of filter below the sealing surface 76. This causes either the portion of the filter and/or the well below that surface to absorb the thermal energy causing it to soften or melt. As the filter is porous, a portion of the filter beneath the sealing surface collapses and is rendered non-porous as well as thermally bonding to the well portion below it. In this manner, a fluid tight seal is formed between the membrane and the well around the periphery of the opening in the bottom of the well. Polymer sealing also could be used.

The type of membrane suitable is not particularly limited, and can include nitrocellulose, cellulose acetate, polycarbonate, polypropylene and PVDF microporous membranes, PES or ultrafiltration membranes such as those made from polysulfone, PVDF , cellulose or the like. Each well contains or is associated with its own support 111 that can be the same or different from the support associated with one or more of the other wells. Each such individual support is preferably coextensive with the bottom of its respective well.

Figure 5:
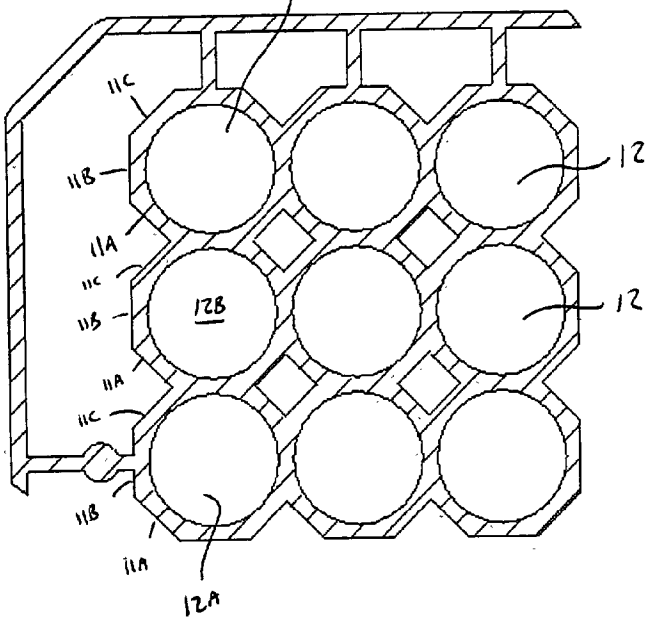
FIG. 5 is a cross-sectional view showing a portion of the underside of the multiwell device in accordance with the present invention.
Figure 4:
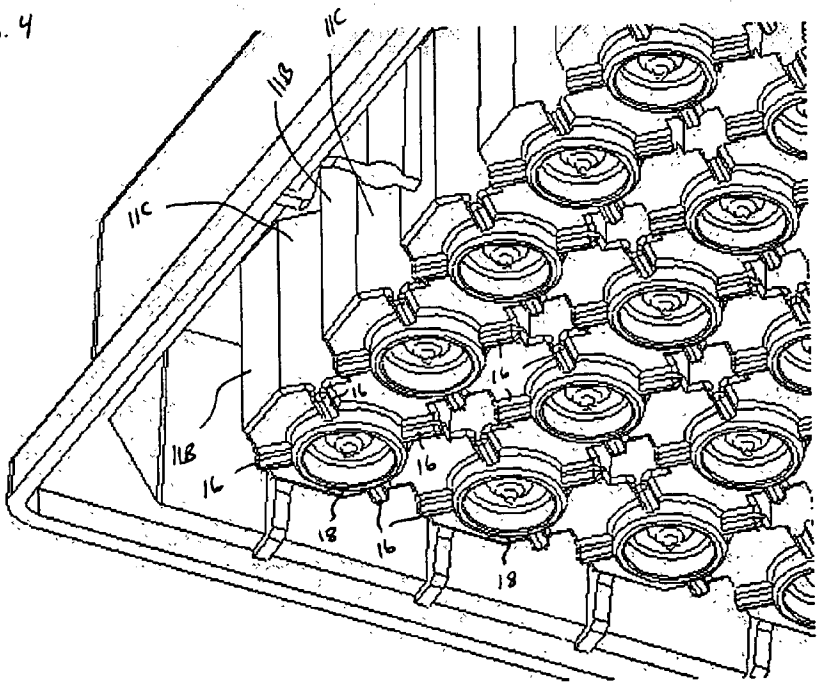
FIG. 4 is an enlarged partial perspective view showing the underside of a multiwell device in accordance with the present invention.

Turning now to FIGS. 4 and 5, the honeycomb structure of the plate 10 of the present invention can be seen. The wells 12 are formed in an array such that the rigid walls between the wells 12 form an octagonal or honeycomb pattern, as best seen by the walls 11A, 11B and 11C in the wells 12A, 12B and 12C that are located at the edge of the plate. The honeycomb pattern provides excellent rigidity and flatness to the device, enabling the device to be compatible with the relatively high forces associated with centrifugation that are typically necessary for ultrafiltration applications where vacuum forces may be insufficient.

The well design of the present invention is such that the well walls 11 shared by adjacent wells are thinner than in conventional plates. Stated differently, the distance between wells is decreased, so that the volume of each well is greater than in conventional plates of the same overall size. The honeycomb structure allows this configuration without sacrificing rigidity or strength. In a 96 well plate, for example, conventional well volume is 480 microliters per well. In the plate of the present invention, the well volume of an individual well in a 96 well format is 600 microliters. In addition, the resulting bottom well diameter is 8 mm compared to 7.2 mm in conventional designs, resulting in an active filtration area increase of 23%.

Figure 8:
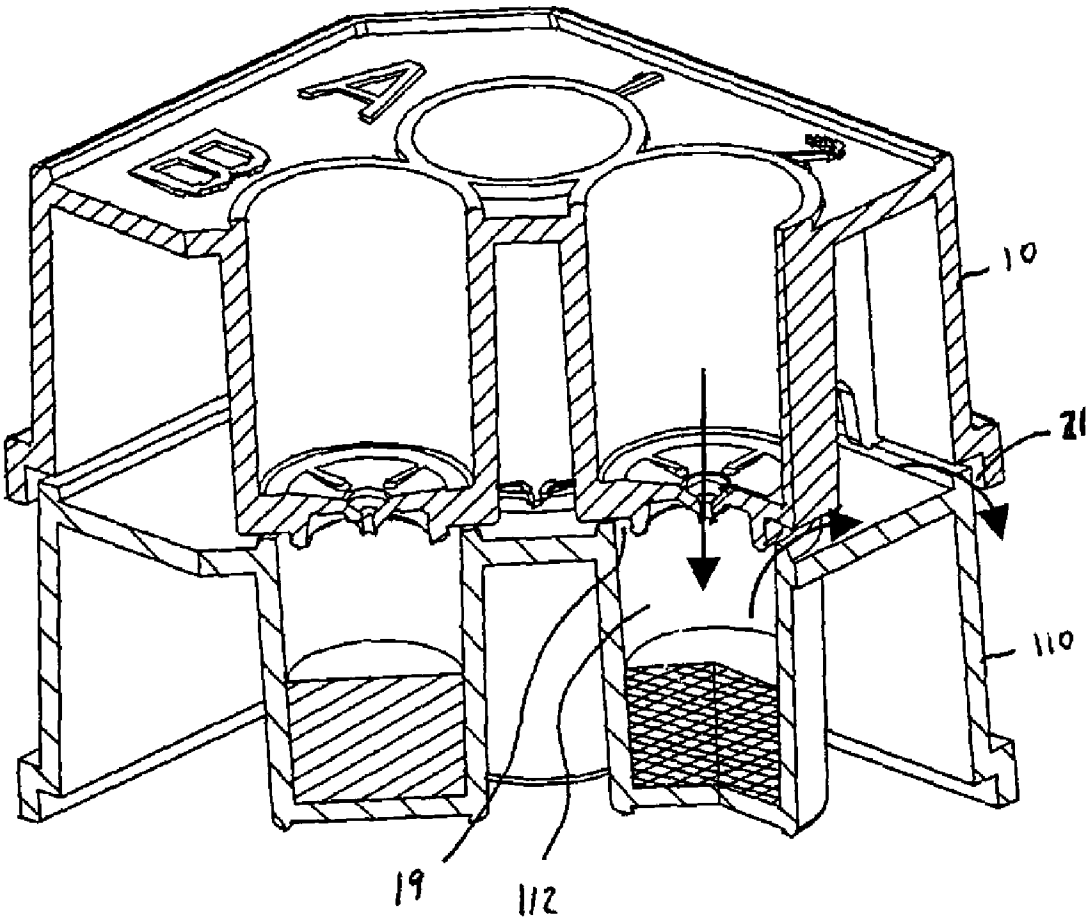
FIG. 8 is a perspective view in partial cross-section showing a portion of the filtration plate positioned on a collection plate in accordance with the present invention.

As shown in FIGS. 6–8, each well has a drain 33 formed in the bottom of the well, preferably centrally located therein. The drain allows fluid (usually filtrate) in the well to escape and potentially be collected such as by a collection plate.

FIG. 4 also illustrates a plurality of spaced supporting ribs 16 extending from the bottom of each well 12. In the preferred embodiment shown, each well has four equally spaced supporting ribs 16 extending from the outer perimeter of the bottom 18 of each well, although fewer or more supporting ribs could be used and the spacing could be varied. As best seen in FIG. 7, the bottom 18 of each well preferably has a perimeter smaller than the perimeter of the well 12, so that when associated with a collection plate, the bottom 18 of the well 12 sits in the collection plate well. The plate 10 is supported on the collection plate by supporting ribs 16, eliminating the need for spacers or supporting frames that are conventionally required to support the filtration plate when positioned over the collection plate.

In addition, this configuration provides vents for the passage of air in order to vent the collection plate curing vacuum or centrifugation. Specifically, the outer perimeter of the bottom 18 of the well is carefully chosen to be slightly less than inner perimeter of the collection plate well, so that a small gap 19 exists between the bottom 18 of the filtration plate well 12 and the top of the collection plate well, as seen in FIG. 8. The gap 19, which in the case of cylindrical wells is an annular gap, is sufficient to allow for gas to vent from the collection plate well 112.

A gap 21 is also formed between the perimeter of the filtration plate 10 and the collection plate 110 to further vent gas vented from the wells 112, as depicted by the arrows in FIG. 8. As best seen in FIG. 7, the perimeter of the filtration plate 10 has a shoulder 34 and skirt 36 that lies beyond the perimeter of the collection plate when the filtration plate 10 is positioned and supported on the collection plate 110. The gap 21 is formed between the skirt 36 and the outer perimeter wall of the collection plate 110.

Figure 9:
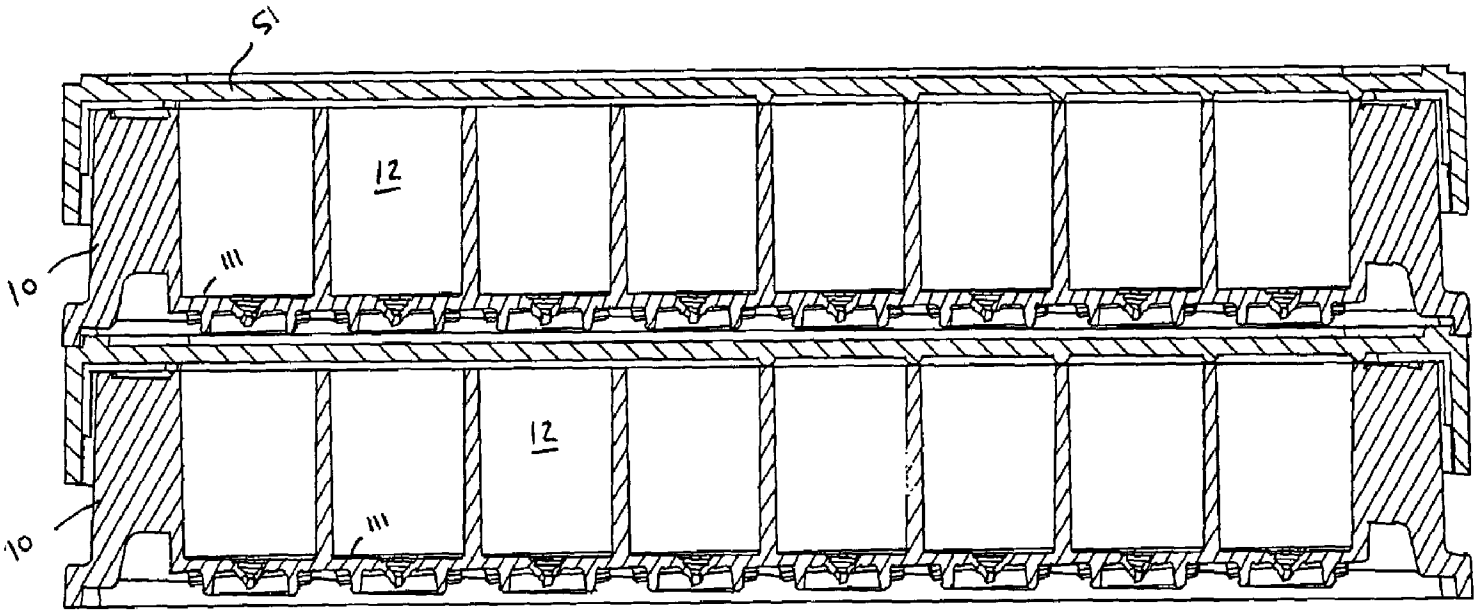
FIG. 9 is a cross-sectional view of two filtration plates stacked one on another in accordance with the present invention.

The configuration of the filtration plate 10 in accordance with the present invention allows for multiple filtration plates to be stacked one over the other, as shown in FIG. 9. This feature of the present invention can be used for conveniently storing the plates, or can be used during an application by conducting multiple filtrations. For example, membranes with different properties can be used in successive plates to retain specific components on each membrane. Thus, a first or top plate could have microfiltration membranes and a second or bottom plate could have ultrafiltration membranes.

What is claimed is:

1. A device comprising: a tray having a plurality of wells, each said well having fluid impervious walls, a bottom, and a drain in said bottom and a support positioned in said well such that fluid in said well must pass through said support prior to entering said drain, wherein said support is a membrane, said wells arranged in said tray in an array, said walls of each well defining a cylindrical inner well volume and a non-cylindrical outer honeycomb pattern so as to maximize well volume.

2. The device of claim 1, further comprising a collection plate having a plurality of collection wells, each collection well being in fluid communication with a respective well of said tray.

3. The device of claim 2, wherein each well of said tray has an underside and a plurality of spaced supporting ribs extending from said underside, said plurality of spaced ribs supporting said tray on top of said collection plate.

4. The device of claim 3, wherein a gap is formed between said tray and said collection plate to vent gases from the collection wells.

5. The device of claim 3, wherein the underside of each well has an outer perimeter smaller than the inner perimeter of each collection well, whereby when each said collection well is in fluid communication with a respective well of said tray, said outer perimeter is positioned in said collection well.

6. The device of claim 1, wherein said tray is a first tray, and further comprising a second tray having a plurality of second tray wells, each said second tray well having fluid impervious walls, a bottom, and a drain in said bottom, said second tray wells arranged in said second tray in a honeycomb pattern so as to maximize well volume, said second tray being in fluid communication with said first tray.

7. The device of claim 1, wherein each said well has a volume of 600 microliters.

8. The device of claim 1, wherein said support is sealed in each well from the top.

9. The device of claim 8, wherein said support is heat sealed in each well.

10. A device comprising: a tray having a plurality of wells, each said well having fluid impervious walls, a bottom, and a drain in said bottom and a support positioned in said well such that fluid in said well must pass through said support prior to entering said drain, wherein said support is a membrane, said wells arranged in said tray in an array, said walls of each well defining a cylindrical inner well volume and an outer octagon pattern so as to maximize well volume.

11. The device of claim 10, further comprising a collection plate having a plurality of collection wells, each collection well being in fluid communication with a respective well of said tray.

12. The device of claim 11, wherein each well of said tray has an underside and a plurality of spaced supporting ribs extending from said underside, said plurality of spaced ribs supporting said tray on top of said collection plate.

13. The device of claim 12, wherein a gap is formed between said tray and said collection plate to vent gases from the collection wells.

14. The device of claim 12, wherein the underside of each well has an outer perimeter smaller than the inner perimeter of each collection well, whereby when each said collection well is in fluid communication with a respective well of said tray, said outer perimeter is positioned in said collection well.

* * * * *